US006163992A

United States Patent [19]

Chou

[11] Patent Number: 6,163,992

[45] **Date of Patent: *Dec. 26, 2000**

[54] MOTION TOY

[75] Inventor: Jin-Long Chou, Taipei Hsien, Taiwan

[73] Assignee: Blue Ridge Designs, Inc., Boone, N.C.

[ * ] Notice: This patent is subject to a terminal disclaimer.

[21] Appl. No.: 09/310,931

[22] Filed: May 13, 1999

Related U.S. Application Data

[63] Continuation of application No. 09/014,103, Jan. 27, 1998, Pat. No. 5,941,756.

[51] Int. Cl.[7] ..... G09F 19/08

[52] U.S. Cl. ..... 40/411; 74/89.17; 74/98; 446/330

[58] Field of Search ..... 446/3, 352, 353, 446/278, 487, 330; 40/411, 414; 74/89.17, 98

[56] References Cited

U.S. PATENT DOCUMENTS

| | | | |
|---|---|---|---|
| 291,200 | 1/1884 | Kayser | 74/98 X |
| 674,970 | 5/1901 | Kennedy . | |
| 711,510 | 10/1902 | Little . | |
| 842,416 | 1/1907 | Nelson | 74/89.17 X |
| 1,415,344 | 5/1922 | Haskell . | |
| 1,423,383 | 7/1922 | Zaiden . | |
| 1,661,093 | 2/1928 | Rogers . | |
| 1,674,943 | 6/1928 | Berger . | |
| 1,685,358 | 9/1928 | Harcourt . | |
| 2,637,936 | 5/1953 | Dale et al. . | |
| 2,691,845 | 10/1954 | Jepson . | |
| 2,859,630 | 11/1958 | Hatch | 74/89.17 X |
| 3,613,299 | 10/1971 | Amici et al. . | |
| 3,643,374 | 2/1972 | Gunther et al. . | |
| 3,660,931 | 5/1972 | Gardel et al. . | |
| 3,858,353 | 1/1975 | Glass et al. . | |
| 3,888,023 | 6/1975 | Genin . | |
| 4,040,206 | 8/1977 | Kimura . | |
| 4,136,874 | 1/1979 | McCord . | |
| 4,505,472 | 3/1985 | Lorenc et al. . | |
| 4,545,775 | 10/1985 | Kim . | |
| 4,676,764 | 6/1987 | Yeu . | |
| 4,801,285 | 1/1989 | Yeu . | |
| 4,828,530 | 5/1989 | Lee | 40/419 X |
| 4,836,819 | 6/1989 | Oishi et al. . | |
| 4,846,752 | 7/1989 | Combs . | |
| 4,867,730 | 9/1989 | Lee . | |
| 4,869,703 | 9/1989 | Ong | 40/414 X |
| 4,878,874 | 11/1989 | Terzian . | |
| 4,878,878 | 11/1989 | Bittner . | |
| 4,889,027 | 12/1989 | Yokoi . | |
| 4,901,459 | 2/1990 | Lee | 40/414 |
| 4,923,428 | 5/1990 | Curran . | |
| 4,944,708 | 7/1990 | Kawabe . | |
| 5,022,533 | 6/1991 | Lin . | |
| 5,099,714 | 3/1992 | Hutchison | 74/89.17 X |
| 5,147,238 | 9/1992 | Kelley et al. . | |
| 5,176,560 | 1/1993 | Wetherell et al. . | |
| 5,205,775 | 4/1993 | Brodrib . | |
| 5,224,896 | 7/1993 | Terzian . | |
| 5,259,806 | 11/1993 | Chang . | |
| 5,273,479 | 12/1993 | Chang . | |
| 5,318,471 | 6/1994 | Glovier . | |
| 5,609,340 | 3/1997 | Chuang . | |
| 5,700,178 | 12/1997 | Cimerman et al. . | |
| 5,735,726 | 4/1998 | Cohen | 40/414 X |
| 5,911,617 | 6/1999 | Chou . | |
| 5,941,756 | 8/1999 | Chou | 40/414 X |

FOREIGN PATENT DOCUMENTS

| | | |
|---|---|---|
| 535765 | 12/1958 | Belgium . |
| 2221401 | 2/1990 | United Kingdom . |

*Primary Examiner*—Joanne Silbermann
*Attorney, Agent, or Firm*—Smith, Gambrell & Russell, LLP

[57] ABSTRACT

A motion toy includes a frame structure covered with a decorated shell and a power drive controlled to move parts of the frame structure. The frame structure has two vertical upper side boards and two vertical lower side boards hinged together, a horizontal shoulder board coupled between the vertical side boards at the top, a horizontal upper link coupled between the vertical upper side boards and the vertical lower side boards, and a horizontal bottom link coupled between the vertical lower side boards at the bottom side. This bottom link is reciprocated by the power drive. Each vertical upper side boards has a respective sector gear respectively meshed with a respective sector gear on the vertical lower side boards.

29 Claims, 5 Drawing Sheets

MOTION TOY

This application is a continuation of U.S. patent application Ser. No. 09/014,103 filed Jan. 27, 1998, now U.S. Pat. No. 5,941,756.

BACKGROUND OF THE INVENTION

The present invention relates to motion toys, and more particularly to a motion toy which uses a reversible motor to turn a frame structure, causing vertical upper side boards and vertical lower side boards of the frame structure to oscillate in reversed directions.

A variety of motion toys have been disclosed, and have appeared on the market. These motion toys commonly use a motor to turn a transmission gear train, causing the transmission gear train to move eccentric rods or cams. so as to move movable parts of the toy back and forth. This motion mode is monotonous and less attractive.

SUMMARY OF THE INVENTION

The present invention provides a motion toy which comprises a frame structure covered with a decorated shell and a power drive controlled to move parts of the frame structure. The frame structure comprises two vertical upper side boards and two vertical lower side boards hinged together, a horizontal shoulder board coupled between the vertical side boards at the top, a horizontal upper link coupled between the vertical upper side boards and the vertical lower side boards, and a horizontal bottom link coupled between the vertical lower side boards at the bottom side and reciprocated by the power drive, the vertical upper side boards having a respective sector gear respectively meshed with respective sector gears on the vertical lower side boards. The power drive comprises a reversible motor controlled by a control circuit to reciprocate the horizontal bottom link through a transmission mechanism.

DETAILED DESCRIPTION OF THE PREFERRED EMBODIMENT

Figure 1:
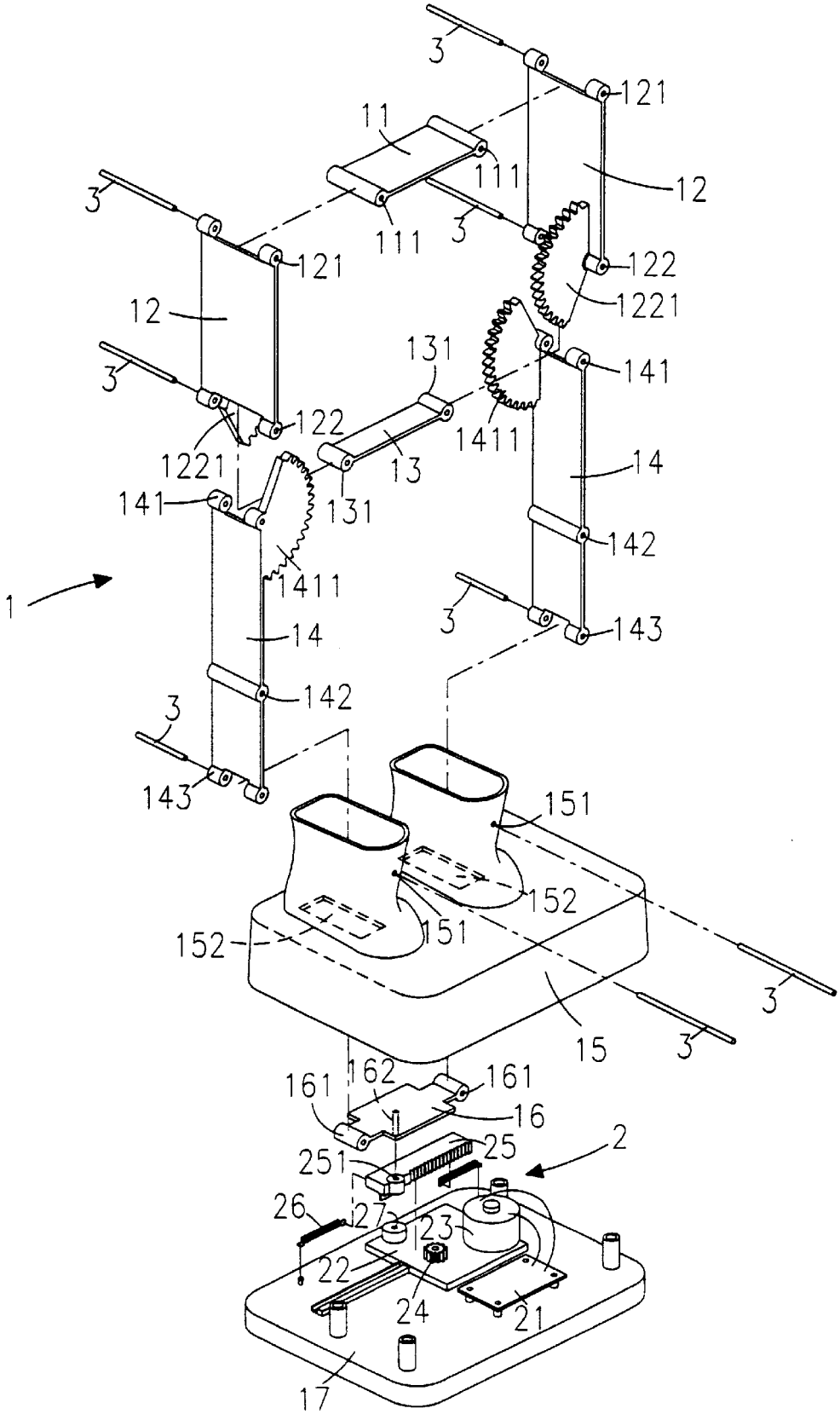
FIG. 1 is an exploded view of a motion toy according to the present invention (the decorative shell excluded).

Referring to FIG. 1, a motion toy in accordance with the present invention is generally comprised of a frame structure 1, a power drive 2, and a plurality of pivot pins 3. The frame structure 1 is covered with a decorative shell (not shown) having any of a variety of designs (the decorative shell can have the shape of a Santa Claus, a little bear, etc.).

Figure 2:
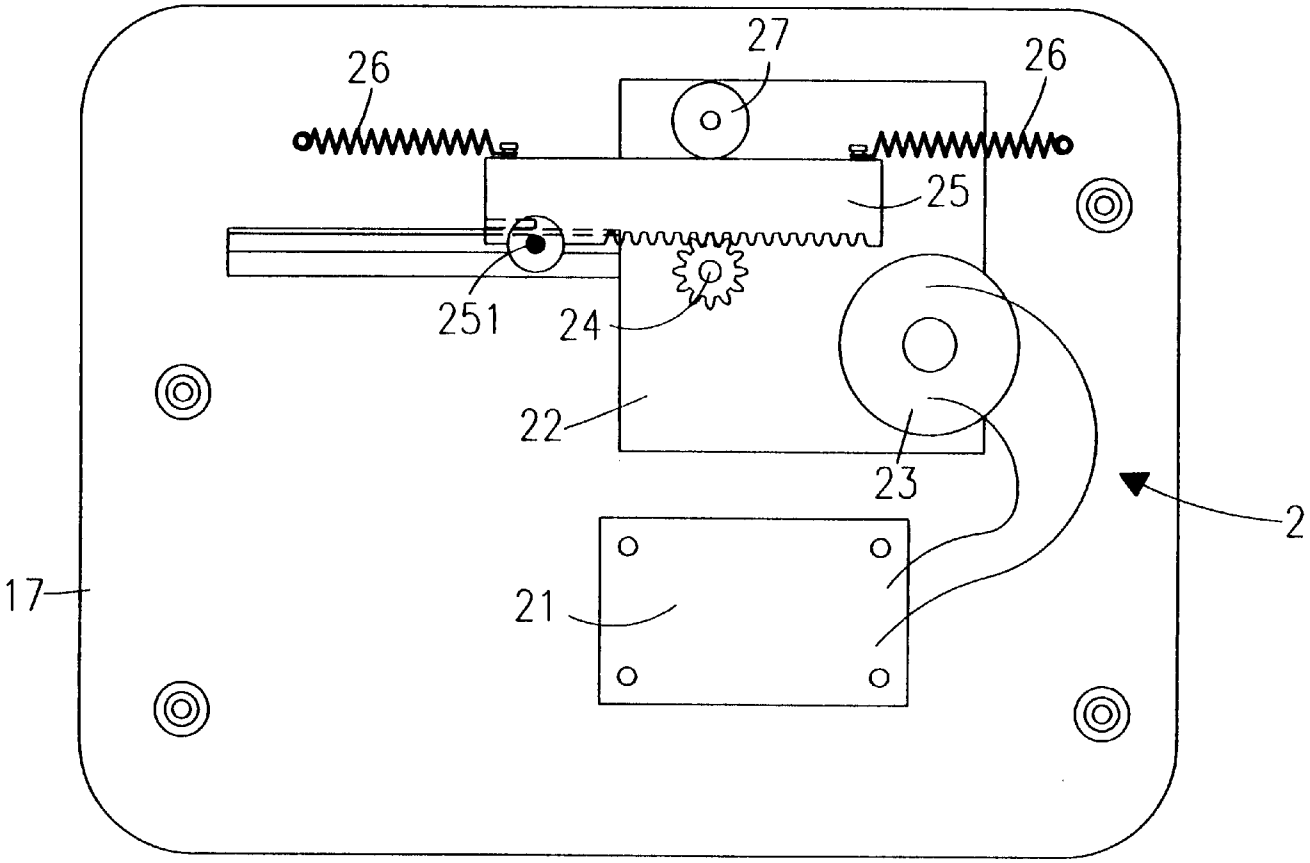
FIG. 2 is a top plain view of the power drive for the motion toy according to the present invention.
Figure 3:
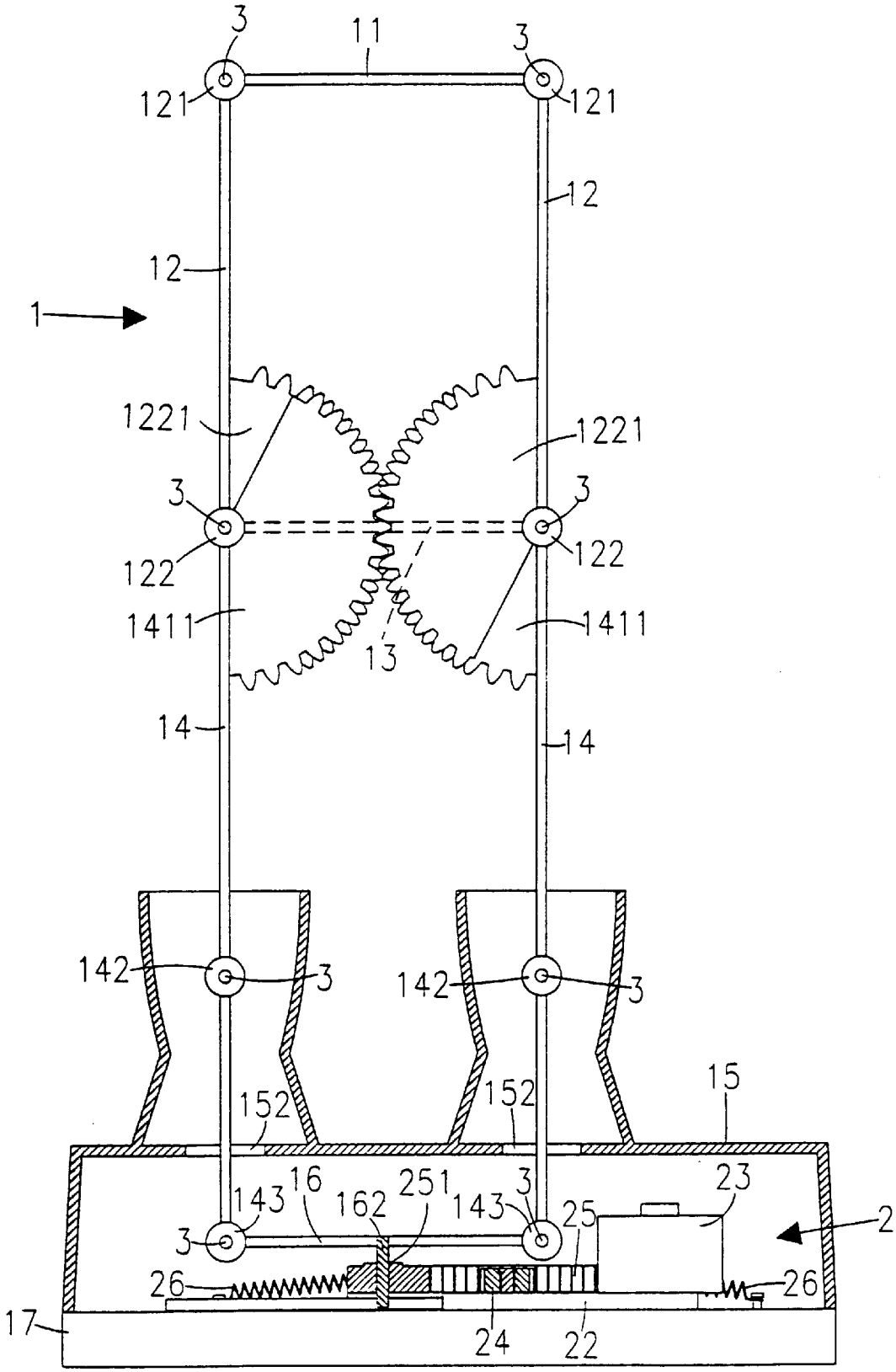
FIG. 3 is a sectional view of the present invention, showing the upper side boards and the lower side boards vertically aligned.

Referring to FIGS. 2 and 3 and FIG. 1 again, the frame structure 1 comprises a bottom plate 17 and a hollow foot plate 15 covering on the bottom plate 17, the hollow foot plate 15 having two boot-like receptacles 151. The frame structure 1 further includes two through holes 152 through the bottom side of the boot-like receptacles 151, a horizontal shoulder board 11 having two transverse axle holes 111 at two sides, and two vertical upper side boards 12 bilaterally hinged to the shoulder board 11, each vertical upper side board 12 having two first barrels 121 bilaterally disposed at the top side and pivotably connected to two opposite ends of one transverse axle hole 111 on the horizontal shoulder board 11 by one pivot pin 3. Two second barrels 122 are bilaterally disposed at the bottom side of the upper side boards 11, and a sector gear 1221 is provided at the bottom side of the upper side boards 11. A horizontal upper link 13 is coupled between the second barrels 122 of the vertical upper side boards 12, the horizontal upper link 13 having two axle holes 131 at two opposite sides. Two vertical lower side boards 14 are respectively hinged to the vertical upper side boards 12 and inserted through the through holes 152 in the boot-like receptacles 151 of the hollow foot plate 15, each vertical lower side board 14 having two first barrels 141 bilaterally disposed at the top and pivotably connected to two opposite ends of one axle hole 131 on the horizontal upper link 13 between the second barrels 122 of one vertical upper side board 12 by one pivot pin 3. A sector gear 1411 is provided at the top of the vertical lower side boards 14, and this section gear 1411 is meshed with the sector gear 1221 on one vertical upper side board 12. A transverse axle hole 142 on the middle of the vertical lower side boards 14 pivotably couples to the inside wall of one boot-like receptacle 151 on the hollow foot plate 15 by one pivot pin 3. Two second barrels 143 are bilaterally disposed at the bottom of the vertical lower side boards 14, and a horizontal bottom link 16 couples between the vertical lower side boards 14 at the bottom inside the foot plate 15, the horizontal bottom link 16 having two transverse axle holes 161 at two opposite sides respectively pivotably connected between the second barrels 143 of the vertical lower side boards 14 by a respective pivot pin 3.

The power drive 2 comprises a motor mount 22 fixedly mounted on the bottom plate 17 inside the hollow foot plate 15; a reversible motor 23 mounted on the motor mount 22; a control circuit 21 mounted on the bottom plate 17 for controlling the operation of the reversible motor 23; a transmission gear 24 mounted on the motor mount 22 and coupled to the output shaft of the reversible motor 23 through a reduction gear train (not shown); a roller 27 horizontally supported on the motor mount 22; a movable rack 25 having a toothed front side meshed with the transmission gear 24, a plain rear side supported on the roller 27, and a locating hole 251 at one end of the toothed front side and connected to the horizontal bottom link 16 by a pin 162; and two tensile springs 26 respectively connected between the bottom plate 17 and two opposite ends of the plain rear side of the movable rack 25.

Figure 4:
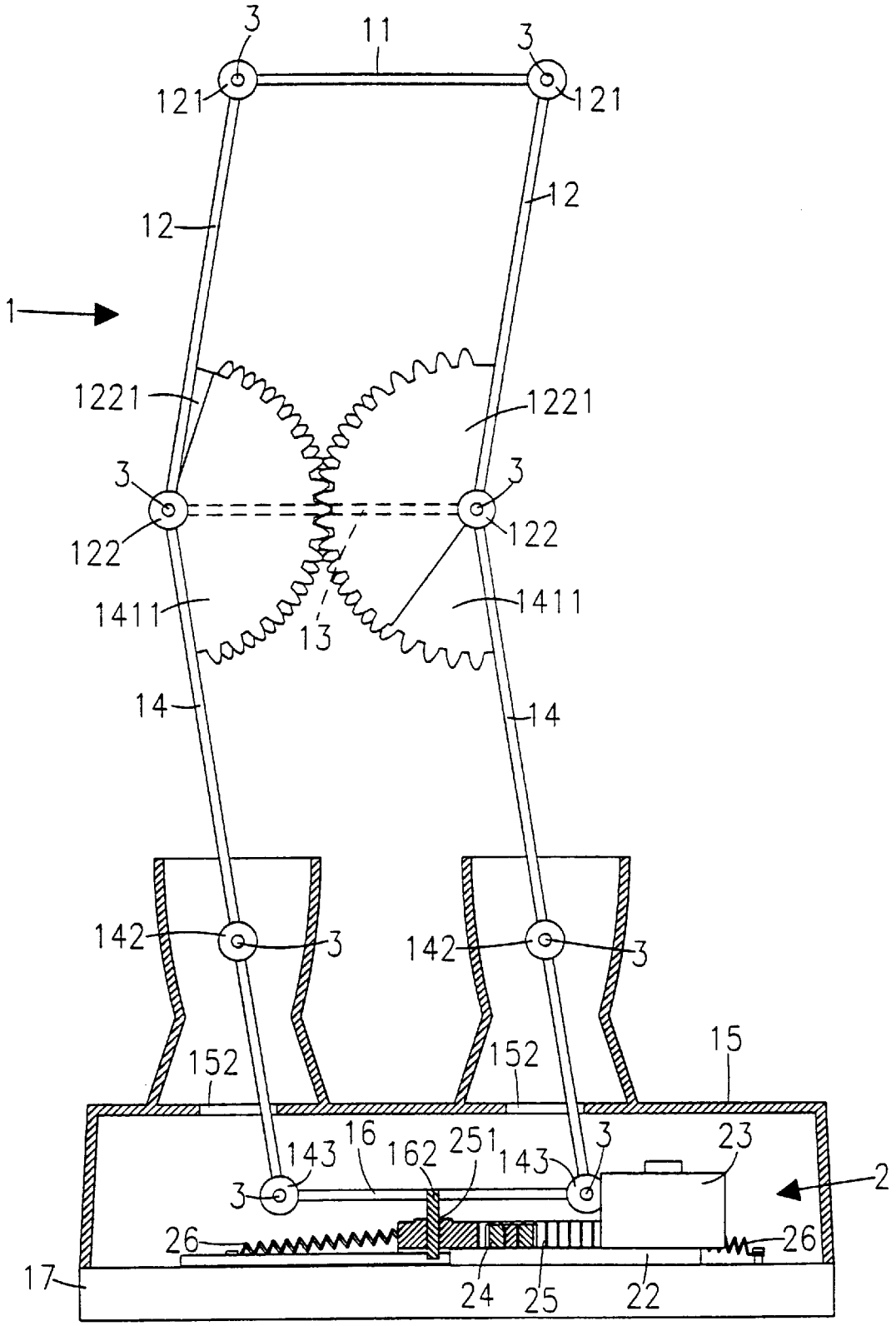
FIG. 4 is another sectional view of the present invention, showing the lower side boards tilted leftward, the upper side boards tilted rightward.
Figure 5:
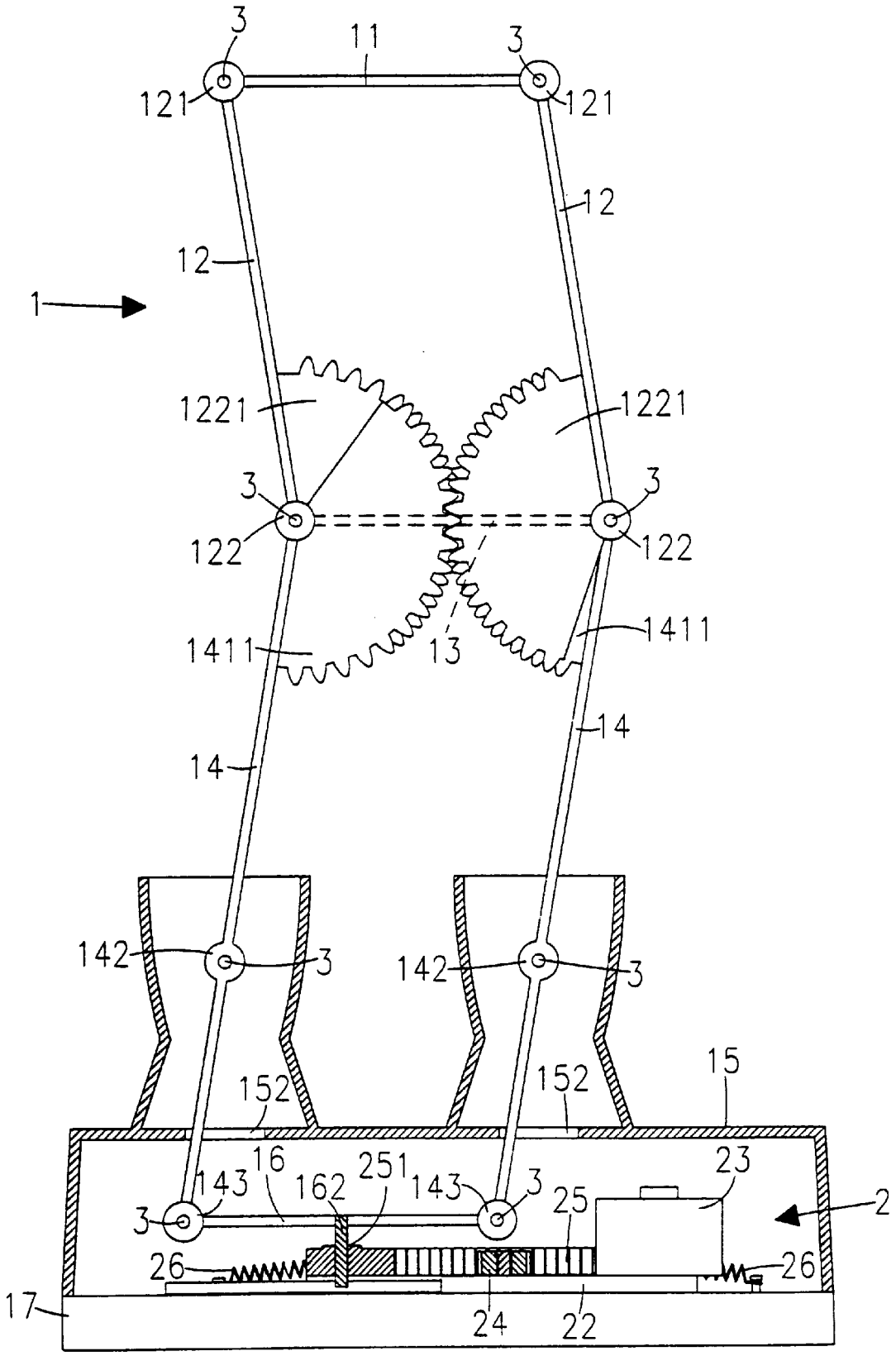
FIG. 5 is still another sectional view of the present invention, showing the lower side boards tilted rightward and the upper side boards tilted leftward.

Referring to FIGS. 4 and 5 and FIG. 3 again, when started, the reversible motor 23 is controlled by the control circuit 21 to turn the transmission gear 24 clockwise and counterclockwise alternatively, causing the transmission gear 24 to move the movable rack 25 back and forth horizontally, thereby causing the horizontal bottom link 16 to be moved with the movable rack 25 back and forth. When the horizontal bottom link 16 is moved rightward (see FIG. 4), the vertical lower side boards 14 are tilted leftward, and the vertical upper side boards 12 are tilted rightward due to the engagement between the sector gears 1221 and 1411. On the contrary, when the horizontal bottom link 16 is moved leftward (see FIG. 5), the vertical lower side boards 14 are tilted rightward, and the vertical upper side boards 12 are tilted leftward.

While only one embodiment of the present invention has been shown and described, it will be understood that various modifications and changes could be made thereunto without departing from the spirit and scope of the invention disclosed.

What the invention claimed is:

1. A toy frame structure comprising:

a first lower side board having a first end and a second end opposite the first end;

a second lower side board having a first end and a second end opposite the first end;

a first upper side board having a first end and a second end opposite the first end wherein the first end of the first upper side board is located adjacent the first end of the first lower side board;

a second upper side board having a first end and a second end opposite the first end, wherein the first end of the second upper side board is located adjacent the first end of the second lower side board;

a first link extending between the first ends of the first lower side board and the second lower side board and between the first ends of the first upper side board and the second upper side board;

a second link extending between the second ends of the first upper side board and the second upper side board;

a first gear member located at the first end of the first lower side board; and a second gear member located at the first end of the second upper side board, wherein the first gear member meshes with the second gear member.

2. A toy frame structure according to claim 1, further comprising:

a third gear member located at the first end of the second lower side board; and a fourth gear member located at the first end of the first upper side board, wherein the third gear member meshes with the fourth gear member.

3. A toy frame structure according to claim 2, further comprising:

a third link extending between the second end of the first lower side board and the second end of the second lower side board.

4. A toy frame structure according to claim 3, further comprising:

a base member, wherein the first and second lower side boards are connected to the base member.

5. A toy frame structure according to claim 4, wherein the first lower side board connects with the base member at a position between the first and second ends of the first lower side board.

6. A toy frame structure according to claim 5, wherein the second lower side board connects with the base member at a position between the first and second ends of the second lower side board.

7. A toy frame structure according to claim 4, wherein the third link is located within a chamber defined by the base member.

8. A toy frame structure according to claim 1, wherein the first end of the first lower side board, the first end of the first upper side board, and the first link are connected together at a first common axis.

9. A toy frame structure according to claim 8, wherein the first end of the second lower side board, the first end of the second upper side board, and the first link are connected together at a second common axis.

10. A toy frame structure according to claim 1, further comprising:

a third link extending between the second end of the first lower side board and the second end of the second lower side board.

11. A toy frame structure according to claim 1, further comprising:

a base member, wherein the first and second lower side boards arc connected to the base member.

12. A toy frame structure according to claim 11, wherein the first lower side board connects with the base member at a position between the first and second ends of the first lower side board.

13. A toy frame structure according to claim 12, wherein the second lower side board connects with the base member at a position between the first and second ends of the second lower side board.

14. A motion toy comprising:

a toy frame structure including:

a base member;

a first lower side board connected with the base member, wherein the first lower side board has a first end and a second end opposite the first end;

a second lower side board connected with the base member, wherein the second lower side board has a first end and a second end opposite the first end;

a first upper side board having a first end and a second end opposite the first end, wherein the first end of the first upper side board is located adjacent the first end of the first lower side board;

a second upper side board having a first end and a second end opposite the first end, wherein the first end of the second upper side board is located adjacent the first end of the second lower side board;

a first link extending between the first ends of the first lower side board and the second lower side board and between the first ends of the first upper side board and the second upper side board;

a second link extending between the second ends of the first upper side board and the second upper side board;

a first gear member located at the first end of the first lower side board; and a second gear member located at the first end of the second upper side board, wherein the first gear member meshes with the second gear member; and a power drive operably connected to the toy frame structure so as to provide a motion that moves the first and second gear members with respect to one another.

15. A motion toy according to claim 14, wherein the toy frame structure further includes:

a third gear member located at the first end of the second lower side board; and a fourth gear member located at the first end of the first upper side board, wherein the third gear member meshes with the fourth gear member.

16. A motion toy according to claim 15, wherein the toy frame structure further includes:

a third link extending between the second end of the first lower side board and the second end of the second lower side board.

17. A motion toy according to claim 16, wherein the first lower side board connects with the base member at a position between the first and second ends of the first lower side board.

18. A motion toy according to claim 17, wherein the second lower side board connects with the base member at a position between the first and second ends of the second lower side board.

19. A motion toy according to claim 16, wherein the third link is located within a chamber defined by the base member.

20. A motion toy according to claim 14, wherein the first end of the first lower side board, the first end o f the first upper side board, and the first link are connected together at a first common axis.

21. A motion toy according to claim 20, wherein the first end of the second lower side board, the first end of the second upper side board, and the first link are connected together at a second common axis.

22. A motion toy according to claim 14, wherein the toy frame structure further includes:

a third link extending between the second end of the first lower side board and the second end of the second lower side board.

23. A motion toy according to claim 22, wherein the third link is located within a chamber defined by the base member.

24. A motion toy according to claim 14, wherein the first lower side board connects with the base member at a position between the first and second ends of the first lower side board.

25. A motion toy according to claim 24, wherein the second lower side board connects with the base member at a position between the first and second ends of the second lower side board.

26. A motion toy according to claim 14, wherein the power drive includes a reversible motor.

27. A motion toy according to claim 14, wherein the power drive includes a motor and a rack member that transfers energy from the motor to the toy frame structure.

28. A motion toy according to claim 14, wherein the toy frame structure further includes:

a third link extending between the second end of the first lower side board and the second end of the second lower side board, and wherein the power drive includes a motor and a rack member that transfers energy from the motor to the toy frame structure via the third link.

29. A motion toy according to claim 28, wherein the motor is a reversible motor.

* * * * *